United States Patent [19]

Pouget

[11] 4,258,945

[45] Mar. 31, 1981

[54] LATCH FOR A VEHICLE DOOR

[75] Inventor: René J. Pouget, Levallois-Perret, France

[73] Assignee: Aciers et Outillage Peugeot, Audincourt, France

[21] Appl. No.: 84,341

[22] Filed: Oct. 12, 1979

[30] Foreign Application Priority Data

Oct. 18, 1978 [FR] France ..... 78 29650

[51] Int. Cl.[3] ..... E05C 5/02

[52] U.S. Cl. ..... 292/68; 292/201

[58] Field of Search ..... 292/68, 66, 64, 201, 292/216, 198

[56] References Cited

U.S. PATENT DOCUMENTS

| | | | |
|---|---|---|---|
| 2,709,621 | 5/1955 | Votypka et al. | 292/48 X |
| 3,328,060 | 6/1967 | Soderberg | 292/68 X |
| 3,378,291 | 4/1968 | Brian | 292/68 |
| 4,163,443 | 8/1979 | Peterson | 292/216 X |

*Primary Examiner*—Richard E. Moore

*Attorney, Agent, or Firm*—Sughrue, Rothwell, Mion, Zinn and Macpeak

[57] ABSTRACT

The latch is of the type comprising a case for the latch mechanism and a keeper which is movable relative to the mechanism. An actuating element for releasing the latch mechanism and the keeper for opening the door is provided. Means are provided for reducing the force exerted on the actuating element by the keeper when opening the latch. The force reducing means comprise a lever which is pivotally mounted in the case and comprises at least one stop recess which cooperates with the actuating element and is pivotally mounted on a first link forming a claw for retaining the keeper in the latched positicn of the latch. The first link is pivotally mounted on a second link which is pivotally mounted in the case.

12 Claims, 6 Drawing Figures

LATCH FOR A VEHICLE DOOR

The present invention relates to latches for vehicle doors comprising a case for the latch mechanism, a keeper movable relative to the case, actuating means for releasing the latch mechanism and the keeper for opening the door and means for reducing the force exerted on said actuating means by the keeper when opening the latch.

It is known that in an automobile vehicle, the door is closed by compressing the sealing elements interposed between the door and the body of the vehicle. Thus, the keeper, which is usually placed on the body, exerts while the door is closed a certain force on the latch mechanism which must be overcome when the user releases the latch for opening the door. Consequently, it is of utility in respect of a certain comfort of actuation, to arrange that this opposing force which must be exerted by the user be as weak as possible, which arrangement is still more important if the latch must be provided with an automatic control. Indeed, the dimensions as concerns the volume and overall size and the required opening power, may be reduced if the force to be exerted is reduced.

An object of the invention is to provide a latch of the general type indicated hereinbefore whereby it is possible to reduce the force required for opening to from one-seventh to one-fifth of the force exerted on the keeper by the action of the sealing elements between the door and the body of the vehicle, the latch being furthermore designed in such manner that all requirements to both lateral and longitudinal passive safety of the vehicle are met.

The invention provides a latch of the type indicated hereinbefore, wherein said force reducing means comprise a lever which is pivotally mounted in said case, comprises at least one stop recess cooperating with said actuating means and is pivotally mounted on a first link forming a claw for retaining the keeper in the latched position of the latch, said first link being pivotally mounted on a second link which is pivotally mounted in said case.

Further features and advantages of the invention will be apparent from the ensuing description which is given solely by way of example with reference to the accompanying drawings, in which.

Figure 1:
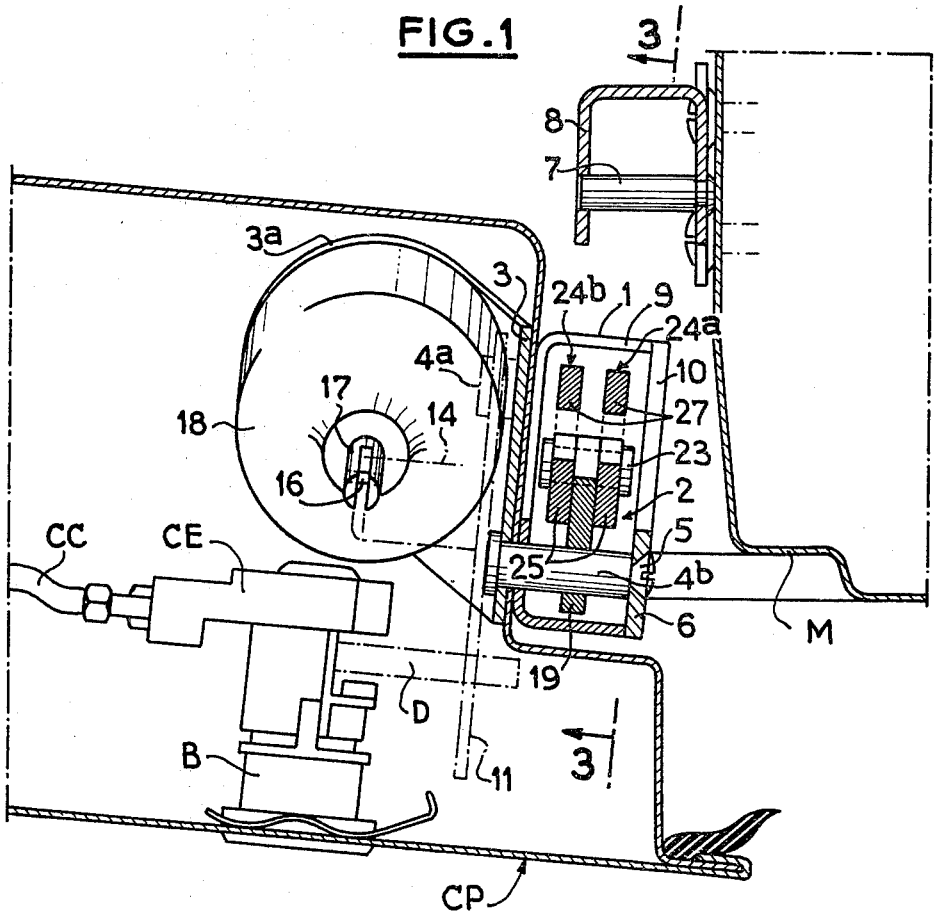
FIG. 1 is a horizontal sectional view of one possible embodiment of a latch according to the invention mounted in an automobile vehicle.

With reference to the Figures which show one embodiment of the invention and in examining more particularly FIG. 1, it can be seen that the latch according to the invention comprises a case 1 housing a latch mechanism 2 and fixed to the rabbet of the a door frame CP of an automobile vehicle. The case 1 is rendered rigid with this frame CP by means of a back-plate 3 and three studs 4*a*, 4*b* and 4*c* which extend outwardly through the rabbet and have a tapped bore in which a fixing screw 5 is received. The screws 5 are adapted to maintain a cover 6 in position on the case 1.

The latch also comprises a keeper 7 which is mounted transversely in a yoke 8 fixed to the side face of the post M of the body of the vehicle in the known manner. The keeper consists of a simple round-sectioned rod. In order to allow the cooperation of this keeper with the latch mechanism 2, the case 1 and the cover 5 are provided with notches 9 and 10 respectively.

The stud 4*a* is extended beyond the inside of the backplate 3 so as to constitute a pivot pin for an actuating element 11 which can consequently pivot in a vertical plane about the axis of the stud 4*a*. The actuating element 11 is provided with a tab 12 (FIG. 2) which is bent at a right angle and extends through a passage 13 provided in the back-plate 3, the rabbet of the door frame CP and the rear wall of the case 1 and is adapted to allow a certain movement of the actuating element 11 bearing in mind the dimensions of the tab 12.

The actuating element also has a connecting tab 14 which extends from the side of the actuating element opposed to the tab 12, the end of this connecting tab being bent at 90° downwardly and provided with a slot 15.

The slot 15 receives a pin 16 which is connected to the movable armature 17 of an electromagnet 18. The latter is fixed to a bracket 3*a* which forms an integral part of the back-plate 3.

In the illustrated embodiment, a lock barrel B of conventional type is provided in the door. This barrel, which is usually mounted on the front doors of the vehicle and is actuated by the user by means of a key, is associated with an electric switch CE which is inserted in a control circuit for opening the doors so as to allow the operation of this circuit by means of a connection conductor CC. The electromagnet 18 is a part of this opening control circuit and may be controlled by a switch (not shown) which is coupled to levers of like elements (not shown) for controlling the opening of the door both from the inside and the outside.

The barrel B may possibly be provided with a control finger member D which may act on the control element 11 to shift the latter when the electric energy supplying the door opening control circuit accidentally drops to a level insufficient to correctly actuate the electromagnets such as 18. For this purpose, the barrel B may have, for example a second normally non-utilized position which is reached by means of the key, after passage through an increased resistance.

Figure 2:
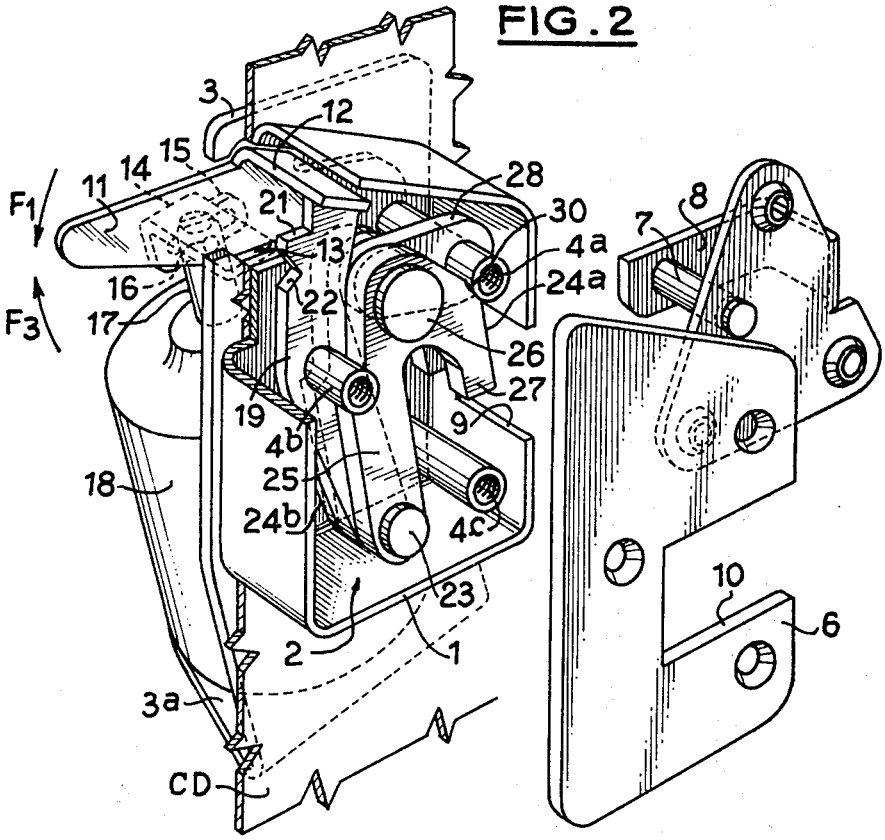
FIG. 2 is an exploded perspective view of this latch.
Figure 6:
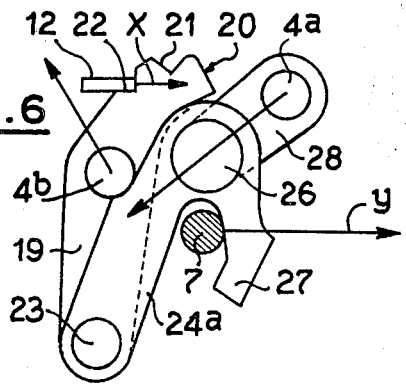
FIG. 6 is a diagram illustrating the reduction of the force obtained by means of the invention.

FIG. 2 permits the examination of the mechanism 2. The latter comprises a pivotal lever 19 pivotally mounted on one, 4*b*, of the studs 4*a* to 4*c*. Its upper end edge constitutes a bearing surface 20 (FIG. 3) and the lever comprises two stop recesses 21 and 22 on the outer side, the bearing surface and the recesses being adapted to selectively cooperate with the tab 12 of the actuating element 11.

The lower end of the pivotal lever 19, which is pivotally mounted in roughly the middle thereof on the stud 4*b*, has a pivot pin 23 extending laterally therethrough and respectively through claw-shaped elements 24*a* and 24*b* also termed hereinafter a double claw. The elements 24*a* and 24*b* are respectively disposed on each side of the lever 19 and have an identical shape. Each claw-shaped element comprises a portion in the form of a link 25 which is pivotally mounted adjacent the lower end thereof on the pin 23 and has another pivot pin 26 which extends through the upper end thereof from which upper end downwardly extends a nose portion 27 for hooking onto the keeper 7.

The link 28 is pivotally mounted on the pin 26 between the two elements 24*a* and 24*b* and this second link is pivotally mounted relative to the case on the stud 4*a*.

Figure 3:
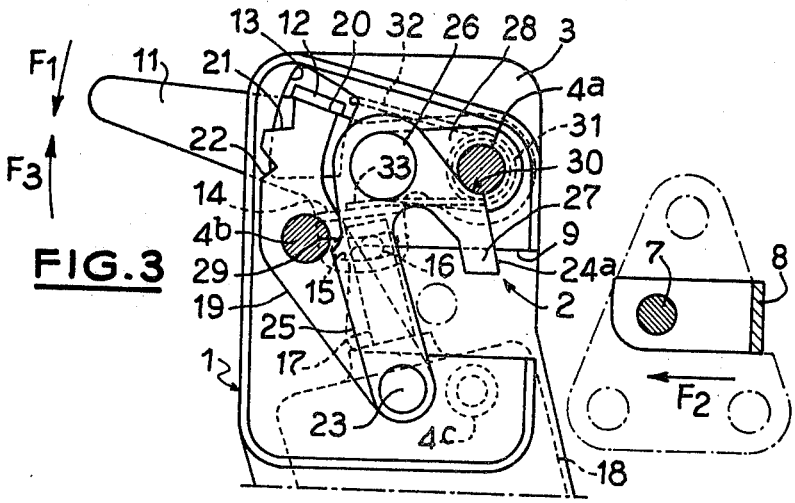
FIGS. 3 to 5 are sectional views taken on line 3—3 of FIG. 1 and illustrating three stages of operation of the latch according to the invention.
Figure 4:
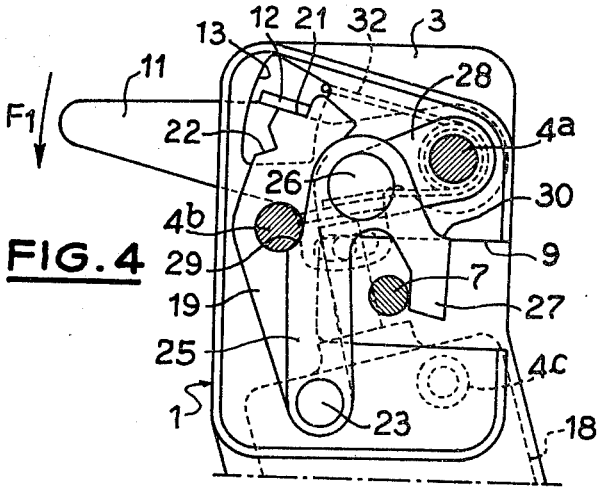
Figure 5:
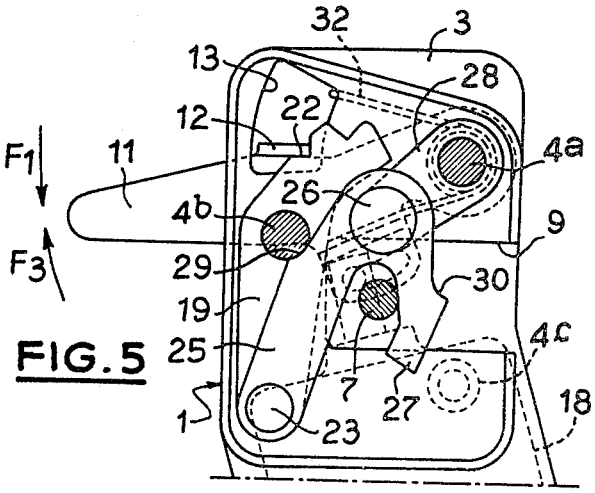

As can be seen in FIGS. 3 to 5 in particular, the double claw 24*a*, 24*b* comprises a first abutment surface 29 located on the lever side and adapted to come in contact with the pivot stud 4*b* in the latched position of the latch. On the opposite side, that is to say on the hooking nose portion 27, the double claw 24*a*, 24*b* has a second abutment surface 30 adapted to come in contact with the pivot stud 4*a* and also employed as an abutment but only in the unlatched or released position of the latch.

A spring is mounted around the part of the stud 4*a* which extends inside the door frame CP. This spring has a first branch 32 hooked in a corner of the opening 13 and a second branch 33 which bears elastically on the lateral tab 14 of the actuating element 11 (FIGS. 3 to 5). This spring 31, whose branches 32 and 33 tend to move away from each other, biases the actuating element 11 downwardly (that is to say in the counter-clockwise direction as viewed in FIGS. 3 to 5) in the direction of arrow F1.

The operation of this latch is as follows (FIGS. 3 to 6):

A—Door open and beginning of the closure:

With the door open, the various component parts are in the positions shown in FIG. 3.

The assembly comprising the lever 19, the double claw 24*a*, 24*b* and the link 28 is maintained in the position shown in FIG. 3 by the bent tab 12 of the actuating element which bears on the face 20 of the lever 19 which is oriented in such manner that the force developed by the spring 31 in the direction of arrow F1 prevents the double claw 24*a*, 24*b* from assuming any position which would prevent effecting the other closing stages.

In order to obtain a fixed opening position, it is desirable to arrange that one of the three elements of the aforementioned assembly be stopped by an abutment rigid with the case 1. As shown, this may be easily obtained in taking advantage of the presence of the stud 4*a* on which may bear the double claw 24*a*, 24*b* by the abutment surface 30. However, any other part of abutment with the case of one of the elements of the assembly would of course be suitable.

At the beginning of the closing, the keeper 7, whose relative movement is indicated by arrow F2, bears against the double claw 24*a*, 24*b*.

As this movement continues, the double claw, under the action of the keeper 7, pivots the lever 19 and the link 28 in such manner that the bent tab 12 of the actuating element 11 is raised but still remains in contract with the surface 20 of the lever 19 owing to the action of the spring 31.

B—Latching with the first stop recess (FIG. 4):

The bent tab 12 of the locking element drops into the first stop recess 21 of the lever 19.

If the closing action is interrupted (the relative displacement of the keeper 7 ceasing), the force exerted by the spring 31 maintains the assembly in a stable position and the nose portion 27 of the double claw 24*a*, 24*b* opposes the opening of the door.

In this position, the opening force transferred to the recess 21 passes through the axis of the stud 4*a* or under this axis.

The door is then in the so-called "first stop recess latching" in which, although the door is not completely closed and its sealing elements are insufficiently compressed, the door is already latched, and is unable to open accidentally.

There is a certain clearance indicated by the two possible positions of the keeper 7 in the double claw 24*a*, 24*b*.

This clearance is discernible by bearing on the outside of the door so as to further compress the sealing elements. When the vehicle is in motion, a characteristic noise warns that the door is not fully closed, without this adversely affecting the safety function.

C—Latching with the second stop recess (FIG. 5):

As the keeper 7 continues its motion, the bent tab 12 of the actuating element 11 drops into a second stop recess 22 of the lever 19 under the action of the force exerted by the spring 31.

As the sealing elements of the door are compressed, the keeper 7 exerts on the double claw 24*a*, 24*b* an action which is opposed by the contact between the second recess 22 of the lever 19 and the bent tab 12 of the actuating element 11.

The opening force transferred to the recess 22 passes through the axis of the stud 4*a* or under this axis.

D—Unlatching-Opening of the door:

To open the door, it is sufficient to pivot the actuating element 11 in the direction of arrow F3 to an upper position which leaves a wide passage for the path of the lever 19. The assembly 19, 24*a*, 24*b*, 28 is then released.

The reaction of the compressed door sealing elements. combined with a possible action of the operator causes the keeper 7 to urge back the double claw 24*a*, 24*b* and it can thus leave the system which trapped it. The reaction produced by the sealing elements may possibly be increased by the action of an elastically yieldable system (not shown) which for example acts on the lever 19 in the unlatching direction. This reaction may possibly replace the action of the sealing elements when the latter have been imperfectly mounted or have lost their elastic property owing to age.

As the actuating element is insufficiently raised, the lever 19 can resume its initial position (FIG. 3) in which it is maintained by the elastic bearing of the tab 12 on the end edge 20.

The movement of the actuating element 11 in the direction of arrow F3 may be brought about either in the conventional way by means of a linkage (not shown) from outside the door or electromagnetically by means of the electromagnet 18.

In the latter case, a knob or lever may excite the electromagnet 18 by an appropriate switching on of the door opening control circuit.

The latch according to the invention only requires a very slight opening force.

Indeed, owing to the force reduction achieved by the assembly 28, 24*a*, 24*b*, 19, a force y exerted by the keeper 7 (owing to the compression of the sealing elements of the closed door) on the nose portion 27 is reduced to from 1/7th to 1/5th in the region of the tab 12 and the recess 22 of the lever 19 (force x). This reduction in the force is due to a judicious calculation of the lengths of the various elements of the assembly. If the state of the surface of the lever 19 in the region of the recess 22 and of the bent tab 12 of the actuating element 11 is such that the coefficient of friction is low, the unlatching force will be practically negligible and in any case compatible with a simple mechanical door opening control and with a direct or indirect electric control since, in this case, it is desirable to employ a minimum amount of energy.

As already mentioned, the barrel B for locking the latch from outside the vehicle may be associated with an actuating finger member D which permits entry to the vehicle even when the source of energy supplying the automatic opening element (electromagnet 18) is too weak, for example after a prolonged inactivity of the vehicle or due to some other cause which had reduced the source of energy of the vehicle.

There may be easily provided a blocking of the unlatching of the latch by provision of a simple mechanism which prevents the actuating element 11 from pivoting upwardly. This blocking may also occur by interruption of the electric supply of the automatic control element.

A mechanical indicator visible from outside the door may be associated with the actuating element 11. This indicator may possibly be itself means for controlling the unlatching and accessible from inside to enable the occupants of the vehicle to leave the vehicle in the case of urgency when the source of energy fails.

Generally, the latch according to the invention lends itself particularly well to an automatic control, since the energy required for its actuation is very low. This control may be achieved by means of an electromagnet such as 18 as described hereinbefore. However, this is only an example. Indeed, the latch may be controlled in a direct electromagnetic manner (for example an electric motor or electromagnet) or indirectly (by an electric pulse which excites an electrically operated valve which releases the supply of pneumatic or hydraulic energy employed by a cylinder device for example).

Having now described my invention what I claim as new and desire to secure by Letters Patent is:

1. A latch for a vehicle door comprising a case, a latch mechanism in the case, a keeper movable relative to the mechanism, an actuating element for releasing the latch mechanism and the keeper for opening the door, and means for reducing the force exerted on the actuating element by the keeper when opening the latch, said force reducing means comprising a lever which is pivotally mounted in said case and comprises at least one stop recess cooperating with said actuating element, a first link forming a claw for engaging and retaining the keeper in a latching position of the latch, and a second link which is pivotally mounted in said case and on which second link the first link is pivotally mounted, the lever being pivotally mounted on the first link.

2. A latch as claimed in claim 1, wherein said first link comprises two identical members forming a claw and disposed on each side of said lever and said second link, each member forming a claw having a portion of the link which is pivotally mounted adjacent respective ends of the portion of the link on the lever and on the second link and a hooking nose portion for retaining the keeper.

3. A latch as claimed in claim 1, wherein said pivotal lever is pivotally mounted on said case in substantially the middle of the lever, a first end of the lever being pivotally mounted on said first link whereas there is formed adjacent an opposite end of the lever at least one stop recess which cooperates with said actuating element.

4. A latch as claimed in claim 3, wherein said actuating element is in the form of a second lever which has a tab bent at a right angle and is mounted on said case to pivot in a plane parallel to the plane of said pivotal lever, said bent tab cooperating with the stop recess.

5. A latch as claimed in claim 4, comprising a pivot pin on which said second link is pivotally mounted, said actuating element being mounted on said case to pivot about said pivot pin.

6. A latch as claimed in claim 4 or 5, comprising an elastically yieldable means for constantly biasing said actuating element in a direction for applying it against said pivotal lever.

7. A latch as claimed in claim 6, wherein said second lever comprises a bearing surface formed by an end edge of the second lever and against which bearing surface bears said bent tab of the actuating element in an open position of the latch.

8. A latch as claimed in claim 5, comprising an elastically yieldable means for constantly biasing said actuating element in a direction for applying it against said pivotal lever, said elastically yieldable means being a spring having a plurality of branches and mounted around said pivot pin.

9. A latch as claimed in claim 1, comprising an automatic control device connected to the actuating element for shifting the actuating element.

10. A latch as claimed in claim 1, wherein an abutment of said case and a bearing surface formed on said first link determined the open position of the latch.

11. A latch as claimed in claim 10, comprising a pivot pin on which said second link is pivotally mounted, said actuating element being mounted on said case to pivot about said pivot pin, said abutment being formed by said pivot pin.

12. A latch as claimed in claim 9, comprising a safety unlatching device which is controlled by means for authorizing the opening of the door and is associated with the actuating element.

* * * * *